US010118815B2

(12) United States Patent
Achatz et al.

(10) Patent No.: US 10,118,815 B2
(45) Date of Patent: Nov. 6, 2018

(54) FILLING ADAPTER (MAINTENANCE CHECK)

(71) Applicant: DÜRR SOMAC GmbH, Stollberg (DE)

(72) Inventors: Thomas Achatz, Niederdorf (DE); Eric Selbmann, Gersdorf (DE); Frank Wieland, Burkhardtsdorf (DE); André Grimm, Treuen (DE)

(73) Assignee: DÜRR SOMAC GmbH, Stollberg (DE)

( * ) Notice: Subject to any disclaimer, the term of this patent is extended or adjusted under 35 U.S.C. 154(b) by 76 days.

(21) Appl. No.: 15/129,993

(22) PCT Filed: Mar. 18, 2015

(86) PCT No.: PCT/DE2015/000141

§ 371 (c)(1),
(2) Date: Sep. 28, 2016

(87) PCT Pub. No.: WO2015/149741

PCT Pub. Date: Oct. 8, 2015

(65) Prior Publication Data

US 2017/0217754 A1 Aug. 3, 2017

(30) Foreign Application Priority Data

Mar. 29, 2014 (DE) ..... 10 2014 004 822

(51) Int. Cl.
*B67D 7/22* (2010.01)
*B67D 7/42* (2010.01)
(Continued)

(52) U.S. Cl.
CPC ..... *B67D 7/32* (2013.01); *B67D 7/22* (2013.01); *B67D 7/425* (2013.01); *G08B 21/18* (2013.01)

(58) Field of Classification Search
CPC . B67D 7/32; B67D 7/425; B67D 7/22; B67D 7/222; B67D 7/221; B67D 7/3245; G08B 21/18; G08B 21/24
See application file for complete search history.

(56) References Cited

U.S. PATENT DOCUMENTS 5,184,309 A * 2/1993 Simpson ..... B67D 7/425 141/392
5,458,170 A * 10/1995 Ferguson ..... B67D 7/425 141/392

(Continued)

FOREIGN PATENT DOCUMENTS

DE 20215082 U1 11/2002
EP 1538125 A1 6/2005

(Continued)

OTHER PUBLICATIONS

International Search Report for PCT/DE2015/000141 dated Sep. 25, 2015 and its translation, 5 pgs.

*Primary Examiner* — Nicolas A Arnett
(74) *Attorney, Agent, or Firm* — Harness, Dickey & Pierce, P.L.C.

(57) ABSTRACT

A filling adapter for a container to be filled with media, in particular for the filling of containers on assembly lines for the production of motor vehicles where the filling adapter is equipped with a hose pack, electrical, pneumatic, and hydraulic lines. An electronic assembly (ID chip) for a maintenance check is integrated in the adapter head of the filling adapter, which assembly detects the number of use cycles of the filling adapter and compares said number with parameters which can be set in advance in such a way that when said parameters are approached, at least one prior warning is triggered, and when said parameters are reached, an associated controller is informed about the maintenance which is now due.

7 Claims, 1 Drawing Sheet

(51) Int. Cl.
*B67D 7/32* (2010.01)
*G08B 21/18* (2006.01)

(56) References Cited

U.S. PATENT DOCUMENTS 5,762,118 A * 6/1998 Epworth ..... B67D 7/145 141/1
5,923,572 A * 7/1999 Pollock ..... B67D 7/222 141/94
6,443,328 B1 * 9/2002 Fehl ..... B67D 7/303 222/1
6,659,306 B2 * 12/2003 Boyle ..... B67D 7/145 222/1
7,647,954 B2 * 1/2010 Garber ..... B67D 7/348 141/346
7,760,104 B2 * 7/2010 Asp ..... B65C 7/00 141/2
7,918,242 B2 * 4/2011 Minamida ..... G03D 3/02 137/209
8,215,522 B2 * 7/2012 Breeser ..... B67D 7/04 222/14
8,464,499 B2 * 6/2013 Asp ..... B65C 7/00 235/375
8,678,049 B2 * 3/2014 Roys ..... B67D 7/344 141/1
9,828,232 B2 * 11/2017 Szeteli ..... B67D 7/0288
2006/0283932 A1 * 12/2006 Asp ..... B65C 7/00 235/375
2008/0230245 A1 * 9/2008 Matsunaga ..... B25B 23/147 173/4
2009/0241744 A1 * 10/2009 Matsunaga ..... B25B 23/147 81/469
2010/0276033 A1 * 11/2010 Asp ..... B65C 7/00 141/2
2012/0305127 A1 * 12/2012 Roys ..... B67D 7/344 141/1
2018/0004233 A1 * 1/2018 Lin ..... G05D 7/0635

FOREIGN PATENT DOCUMENTS

EP 1724065 A1 11/2006
WO WO-0198198 A1 12/2001
WO WO-2013172703 A1 11/2013

* cited by examiner

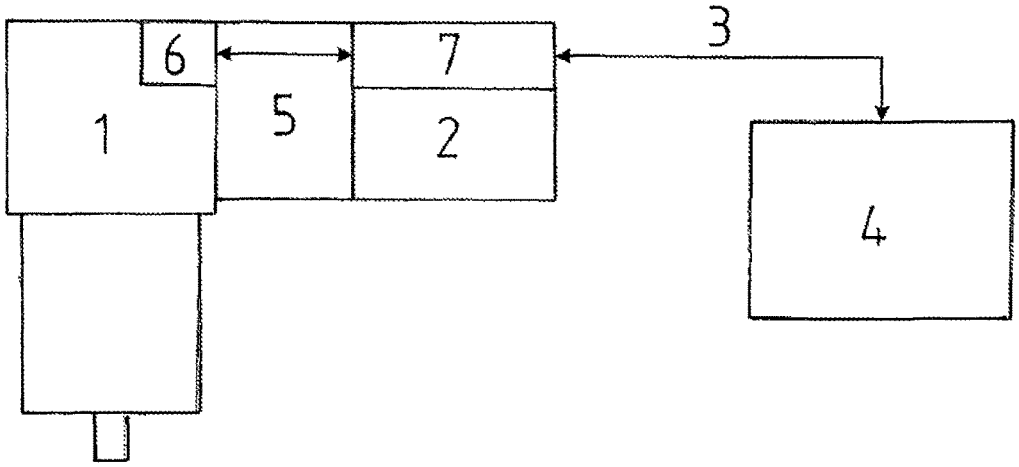
6
7
3
1
5
2
4

FILLING ADAPTER (MAINTENANCE CHECK)

CROSS-REFERENCE TO RELATED APPLICATIONS

This application is a National Stage of International Application No. PCT/DE2015/000141, filed Mar. 18, 2015, claiming benefit to DESN 102014004822.5, filed Mar. 29, 2014. The entire disclosures of each of the above applications are incorporated herein by reference.

FIELD

The present disclosure relates to a filling adapter for a container to be filled with media (e.g. oils, gases, coolants and the like), in particular for the initial filling of containers with operating substances on assembly lines for the production of motor vehicles, wherein the filling adapter is equipped with a hose pack, electrical, pneumatic and hydraulic lines.

BACKGROUND

This section provides background information related to the present disclosure which is not necessarily prior art.

Containers must be filled with liquids or gases for numerous technical applications. A typical application in this respect are motor vehicles where housings, circuits, equalizing reservoirs and the like have to be filled with fuel, lubricants, coolants, and other operating substances. In the manufacturing process, these vehicles must be filled, for example, with brake fluid, power steering fluid, coolant, refrigerant, windshield wiper fluid, and fuel. These media are fed via hoses and special adapters to the respective circuits of the vehicles. The hoses typically include multiple lines with different functions for vacuum application, back suction, filling, aerating, as well as for electrical cables.

To perform the filling, a worker has to bring the adapter and hose pack to the vehicle depending on the respective position of the filling station and connect it to the ports of the circuits to be filled.

These assemblies must undergo periodic maintenance to ensure that the filling adapter is functional. It is preferably performed at defined cycles, which can be related, for example, to continually recurring periods or to utilization periods. However, keeping track of these cycles depends on the thoroughness of the maintenance operations (customer). It cannot be excluded that maintenance intervals are not exactly complied with. Such risk is particularly considerable if the filling adapter is not exclusively used with the same filling station but at various filling stations. For maintenance cycles based on time, it is also questionable if the filling adapter really has been used frequently enough that maintenance is required. For maintenance cycles based on use, multiple filling adapters may be needing maintenance within a short time interval. If these maintenance operations are not performed, there can be unforeseen failures of the filling adapters on the assembly line, which in extreme cases can result in a temporary shutdown of the assembly line.

SUMMARY

This section provides a general summary of the disclosure, and is not a comprehensive disclosure of its full scope or all of its features.

The purpose of this disclosure is to create a technical solution with which the need for maintenance of such a filling adapter is detected and reported promptly and independently of care and expertise of the maintenance team (customer).

This problem is solved with an integrated electronic assembly (ID chip) for a maintenance checks in the head of the filling adapter. So the assembly detects the number of use cycles of the filling adapter and compares said number with parameters which can be set in advance. When said parameters are approached, at least one prior warning is triggered, and when said parameters are reached, an associated controller is informed about the maintenance which is now due.

The prior warning gives a worker a first indication that the filling adapter will soon have to undergo maintenance. Where such a prior warning is transmitted to a control center, e.g. to production management, the worker is relieved and the functioning of the entire filling station can be improved, since this control center can prepare the switchover without impairing the worker's job. This variant s advantageous from a manufacturing point of view, since the filling adapter to undergo maintenance can be replaced with another filling adapter in the rest cycle between two filling cycles.

Furthermore, the adapter head is configured with an electronic interface via which a special software provides information about performed maintenance operations and can switch the electronic assembly (ID chip) to a new initial state for recording the number of utilization cycles of the filling adapter for maintenance monitoring.

This technical solution detects the need for maintenance of a filling adapter regardless of the care and expertise of a worker and indicates it at an early point in time. This permits planned maintenance and reduces unexpected incidents in the production process, e.g. simultaneous replacement of multiple filling adapters. Another advantage is protection from manipulation, since the ID chip documents the actual use conditions. This means that the filling adapter can be used at various filling stations without disadvantages with respect to maintenance.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a cross-view of the disclosure.

Corresponding reference numerals indicate corresponding parts throughout the several views of the drawings.

DETAILED DESCRIPTION

Example embodiments will now be described more fully with reference to the accompanying drawing.

The FIGURE shows an embodiment of the disclosure. It shows the fundamental design of a filling adapter having an adapter head 1, a terminal housing 2 for a hose pack 3, and a station controller 4. An electronic assembly 6 that is in an operative connection with the station controller via an electronic adapter circuit 7 is integrated in the adapter head 1 for maintenance checking. The electronic assembly 6, preferably an ID chip, detects the number of use cycles of the filling adapter and compares said number with parameters which can be set in advance in such a way that when said parameters are approached, at least one prior warning is triggered, and when said parameters are reached, an associated controller 4 is informed about the maintenance which is now due.

Furthermore, an electronic interface 5 is configured on the adapter head 1. This interface 5 uses a special software to provide information about performed maintenance operations and can switch the electronic assembly/ID chip 6 to a new initial state for recording the number of utilization cycles of the filling adapter for maintenance monitoring.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A filling adapter for a container to be filled with media, for the initial filling of containers with operating substances on assembly lines for the production of motor vehicles, wherein the filling adapter is equipped with a hose pack, electrical, pneumatic and hydraulic lines, wherein an electronic assembly is integrated in the adapter head of the filling adapter for maintenance check, which detects the number of use cycles of the filling adapter and compares said number with parameters which can be set in advance in such a way that when said parameters are approached, at least one prior warning is triggered, and when said parameters are reached, an associated controller is informed about the maintenance which is now due.

2. The filling adapter according to claim 1, wherein the prior warning is transmitted directly to the worker at the filling station and/or to a control center.

3. The filling adapter according to claim 1, wherein the adapter head is configured with an electronic interface via which a special software provides information about performed maintenance operations and can switch the electronic assembly to a new initial state for recording the number of utilization cycles of the filling adapter for maintenance monitoring.

4. The filling adapter according to claim 1, wherein the electronic assembly is configured to transmit the first indication that the filling adapter will soon have to undergo maintenance to a worker at a filling station on one of the assembly lines.

5. The filling adapter according to claim 1, wherein the electronic assembly is configured to transmit the first indication that the filling adapter will soon have to undergo maintenance to a control center for one or more of the assembly lines.

6. The filling adapter according to claim 1, further comprising:

an electronic interface electrically connecting the electronic assembly to the controller, the electronic interface programmed with software that provides information about performed maintenance operations and can switch the electronic assembly to a new initial state for recording the number of use cycles of the filling adapter.

7. A filling adapter for the initial filling of containers with operating substances on assembly lines for the production of motor vehicles, the filling adapter comprising:

a hose pack having at least one of electrical, pneumatic, and hydraulic lines;

an adapter head connected in fluid communication with the hose pack and configured to mate with filling ports on the containers;

an electronic assembly integrated in the adapter head that is programmed to perform maintenance checks on the filling adapter by detecting the number of use cycles of the filling adapter and comparing the number of use cycles with at least one pre-set parameter; and a controller arranged in electronic communication with the electronic assembly, wherein the electronic assembly is programmed to trigger at least one prior warning by transmitting a first indication that the filling adapter will soon have to undergo maintenance in response to the number of use cycles approaching the at least one pre-set parameter, wherein the electronic assembly is programmed to transmit a second indication that maintenance of the filling adapter is now due to the controller in response to the number of use cycles reaching the at least one pre-set parameter.

* * * * *